United States Patent [19]

Swenson et al.

[11] Patent Number: 4,485,346

[45] Date of Patent: Nov. 27, 1984

[54] VARIABLE-ENERGY DRIFT-TUBE LINEAR ACCELERATOR

[75] Inventors: Donald A. Swenson; Thomas J. Boyd, Jr.; James M. Potter; James E. Stovall, all of Los Alamos, N. Mex.

[73] Assignee: The United States of America as represented by the United States Department of Energy, Washington, D.C.

[21] Appl. No.: 398,507

[22] Filed: Jul. 15, 1982

[51] Int. Cl.[3] ..... H05H 9/02; H05H 7/12

[52] U.S. Cl. ..... 328/233; 315/5.41; 313/359.1

[58] Field of Search ..... 313/359.1, 360.1; 328/233; 250/492.2, 492.3; 315/5.41

[56] References Cited

U.S. PATENT DOCUMENTS 3,501,734 3/1970 Knapp et al. ..... 328/233

OTHER PUBLICATIONS

Swenson et al., "Variable-Energy Drift Tube Liniacs", Los Alamos National Laboratory LA-UR-81-3696, Dec. 18, 1981.

Swenson et al., "Variable-Energy Drift Tube Liniacs", Proceedings of the 1981 Linear Accelerator Conference, LA-9234-C Feb., 1982, pp. 187-190.

Swenson et al., "Stabilization of the Drift Tube Liniac by Operation in the $\pi/2$ Cavity Mode", 6th Int. Conf. on High Energy Accelerators, CEAL-2000, 1967, pp. 167-173.

Ghiorso et al., "Partial Energy Beams from an Ion Liniac", Proc. 1966 Linear Accelerator Conf., Dec., 1966, pp. 72-77.

*Primary Examiner*—David K. Moore

*Assistant Examiner*—K. Wieder

*Attorney, Agent, or Firm*—Leonard C. Brenner; Paul D. Gaetjens; Michael F. Esposito

[57] ABSTRACT

A linear accelerator system includes a plurality of post-coupled drift-tubes wherein each post coupler is bistably positionable to either of two positions which result in different field distributions. With binary control over a plurality of post couplers, a significant accumlative effect in the resulting field distribution is achieved yielding a variable-energy drift-tube linear accelerator.

7 Claims, 5 Drawing Figures

VARIABLE-ENERGY DRIFT-TUBE LINEAR ACCELERATOR

This invention is the result of a contract with the Department of Energy (Contract No. W-7405-ENG-36).

BACKGROUND OF THE INVENTION

The present invention relates generally to drift-tube linear accelerators and more particularly to variable-energy drift-tube linear accelerators.

Practical applications of proton and ion drift-tube linear accelerators are more viable now than ever before because of the development of the radio-frequency quadrupole (RFQ) accelerating structure and other technological advances. Although many of these applications would benefit from a variable energy option, drift-tube linear accelerators are not noted for this property.

The only variable-energy method known to be in routine use involves turning off later portions of the linear accelerator to provide a few discrete energies from multitank linacs. Many applications require more discrete energies than normally are available from this scheme. Further, single tank, post-coupled drift-tube linear accelerators are advocated for simplicity and reliability and any multitank arrangement to provide energy variability represents a step backward in linac technology.

Post couplers have a special property in that they can introduce a step in the electric fields. Modest perturbations to the symmetry of the post-coupler/drift-tube geometry can introduce few percent cell-to-cell changes in the fields across the post coupler. Several such perturbations on adjacent post couplers can introduce a sizable reduction in the fields over the region of a few cells. Such steps in the fields can be used to drop the beam out of synchronism with the accelerating fields and provide a variable-energy capability for the single-tank, post-coupled drift-tube linear accelerator.

It is therefore an object of the present invention to provide an improved drift-tube linear accelerator with a variable-energy capability.

It is another object of the present invention to provide a reliable post-coupler field-perturbation variable-energy drift-tube linear accelerator.

SUMMARY OF THE INVENTION

To achieve the foregoing and other objects, and in accordance with the purposes of the present invention, as embodied and broadly described herein, the apparatus of this invention may comprise a drift-tube linear accelerator having a plurality of post-couplers wherein each individual post coupler thereof is positionable to a selected one of two positions under the control of a post-coupler controller. In the first position, called the home position, the rf field is unperturbed and the post coupler forces a uniform field distribution across the post coupler. In the second position, called the alternate position, a preset perturbation causes a fixed degree of asymmetry in the post-coupler/drift-tube geometry. In this position, the post coupler introduces a small step of prescribed magnitude of the field distribution across the post coupler. By simple binary control of a plurality of post couplers, a significant accumulative effect is achieved yielding a viable variable energy drift-tube linear accelerator.

One advantage of the present invention is the provision of a single-tank variable energy linear accelerator.

Another advantage of the present invention is that variable energy in a post-coupled drift-tube linear accelerator is achieved under simple binary control.

Still another advantage of the present invention is that variable energy is obtained while each post coupler need be settable to only two positions thereby simplifying control, operation, reliability, rf integrity, and vacuum integrity constraints.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated in and form a part of the specification, illustrate an embodiment of the present invention in a 100 cell drift-tube linac and, together with the description, serve to explain the principles of the invention. In the drawings.

DESCRIPTION OF THE PREFERRED EMBODIMENT

Figure 1:
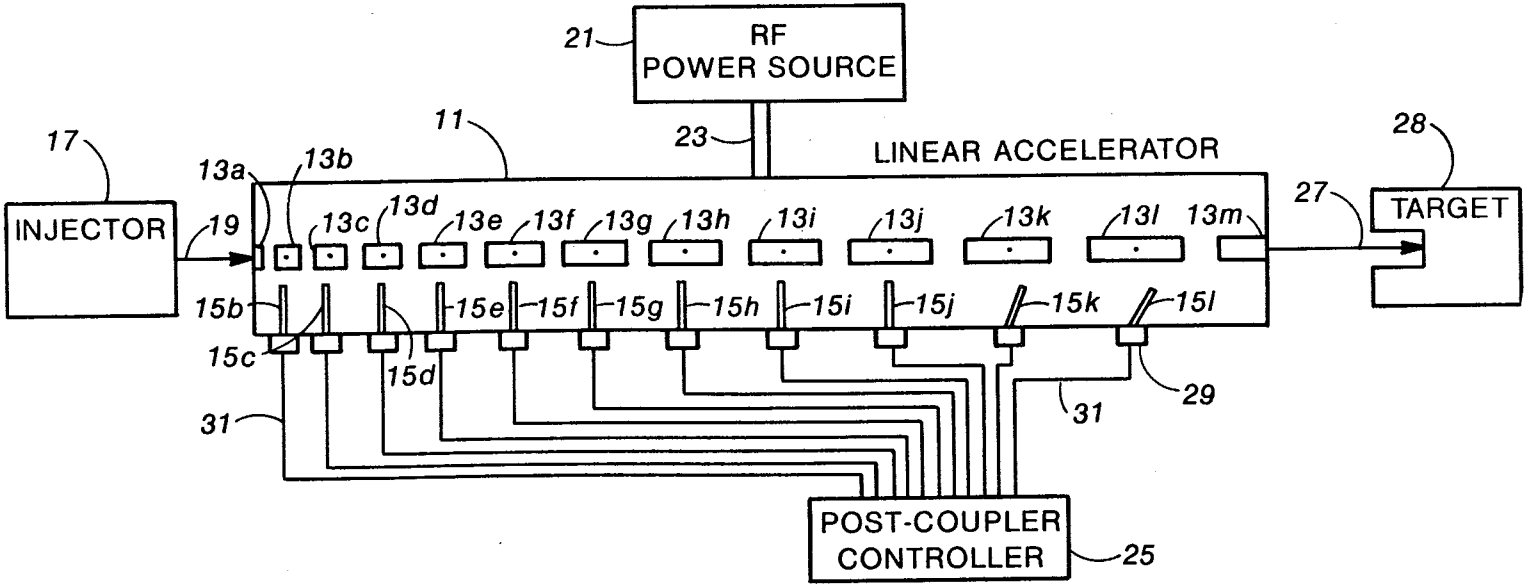
FIG. 1 is an illustration of a variable-energy post-coupled, drift-tube linear accelerator system in accord with the present invention.

With reference to FIG. 1, the present invention, a drift-tube linear accelerator 11, comprises a cylinderical cavity loaded with a chain of drift-tubes 13*a*–13*m*, each drift-tube 13 therein commonly having an associated post coupler 15 excepting possibly the first drift-tube 13*a* and the last drift-tube 13*m*. It should be appreciated that while for clarity purposes only a relatively few drift-tubes 13 are shown in the drift-tube linear accelerator 11 of FIG. 1, the invention certainly applies also both to larger and smaller accelerators having more or fewer drift-tubes 13 in a chain.

In operation, an injector 17 produces a low energy particle beam 19 and injects same into the drift-tube linear accelerator 11 which accelerates the particle beam 19 with radio frequency electric fields as the particles pass between the drift-tubes 13. As shown in FIG. 1, the drift-tubes 13 get successively longer as the particle beam 19 gains speed. The radio frequency fields result from the introduction of rf power from the rf power source 21 through an rf power transmission line 23 into the drift-tube linear accelerator 11. The distribution of fields within the drift-tube linear accelerator 11 are stabilized and controlled by the post couplers 15 located near the drift-tubes 13. Each post coupler 15 has two possible positions, namely a first position called a home position as shown for post couplers 15*b*–15*j*, and a second position called an alternate position as shown for post couplers 15*k* and 15*l*.

The position of each post coupler 15 is controlled by the post-coupler controller 25. The accelerated particle beam 27 energing from the drift-tube linear accelerator 11 is directed towards a target 28. The energy of the accelerated particle beam 27 depends on the distribution of the fields within the drift-tube linear accelerator 11, which depends on the orientation of the post couplers 15 that are controlled by individual post-coupler positioner 29 that in turn are controlled by the post-coupler controller 25.

The post-coupler controller 25 provides a signal to a post-coupler positioner 29 associated with each post-coupler 15. The post-coupler positioner 29 is capable of setting the associated post-coupler 15 in either its home or alternate position. Each post-coupler positioner 29 is individually associated with the post-coupler controller 25 via signal control line 31.

Figure 2:
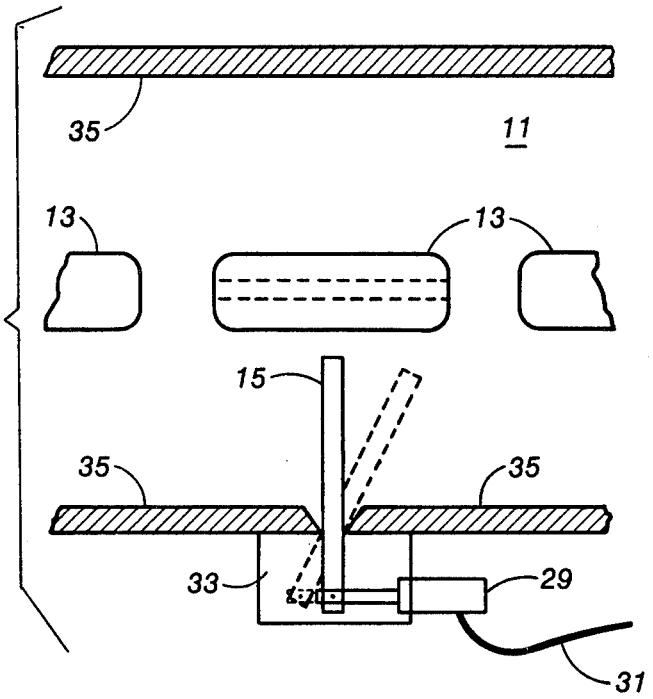
FIG. 2 is a diagram of a binary positionable post coupler used in the linear accelerator system of FIG. 1.

With reference now to FIG. 2 may be seen how an individually post-coupler positioner 29 controls the position of a post-coupler 15. The post-coupler 15 is pivotally secured to the post-coupler positioner 29 within a housing 33. The housing 33 is secured to the wall 35 of the drift-tube linear accelerator 11 and provides both an rf and vacuum shield thereto. Although not shown in FIG. 2, conventional engineering practices to achieve rf and vacuum integrity would normally be employed such as metallic bellows, and O-rings where appropriate. The post-coupler positioner 29 is controllable to two positions for the post-coupler 15. Thus the post-coupler 15 may be set to either its home or alternate position. The post-coupler positioner 29 may be, for example, an air cylinder having a spring return wherein the signal control line 31 would then be a tube for controlling air pressure. Alternatively, the post-coupler positioner 29 may be an electrical solenoid having two positions and the signal control line 31 then would be an electrical line for carrying the electrical signal designating which position the solenoid should assume. Ideally, the home position of the post coupler 15 is the optimum energy position wherein the rf field is unperturbed while the alternative position of post coupler 15 provides an rf field perturbation resulting in an energy decrease from the home position on the order of 2% to 10% decrease. The specific amount of each perturbation is determined, by presetting the amount of deviation between the normal and alternate positions of the post-coupler 15. It is desirable to operate near optimum position and therefore induce only a slight perturbation. However, since a drift-tube linear accelerator 11 may include a rather high plurality of drift-tubes 13, very slight perturbations over a large number of drift-tubes 13 can generate a very sizeable overall energy perturbation for the linear accelerator 11.

Thus post couplers 15 fabricated in accord with the subject invention as above described have a special property in that they can introduce a step in the electric fields. Modest perturbations to the symmetry of the post coupler/drift-tube geometry as described can introduce a few percent cell-to-cell changes in the fields across the post coupler 15. Several such perturbations on adjacent post couplers 15 can introduce a sizable reduction in the fields over the region of a few cells. Such steps in the fields can be used to drop the particle beam out of precise synchronism of the accelerating fields and thus provide a variable energy capability for a single-tank, post-coupled drift-tube linear accelerator 11.

Figure 3:
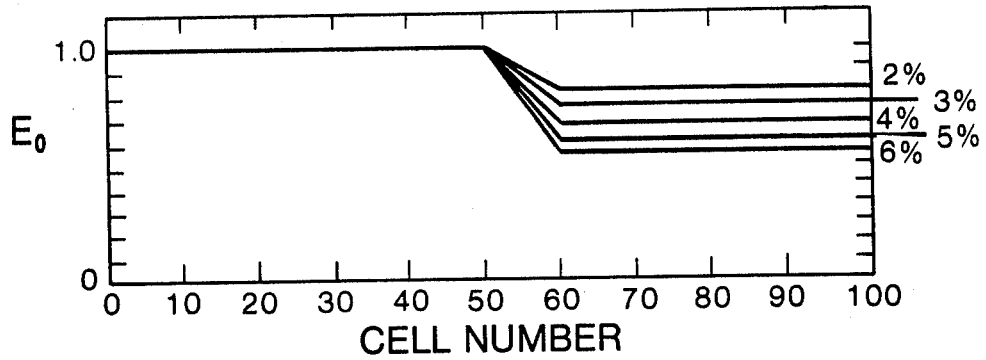
FIG. 3 is a diagram of energy distribution in a linear accelerator having ten 2%, 3%, 4%, 5%, and 6% post-coupler perturbations.

FIG. 3 illustrates the field distributions that can be established in 100 cell, post-coupled drift-tube linear accelerator 11. FIG. 3 illustrates specifically the field distributions that result when 10 adjacent post couplers beginning at cell number 50 are set for perturbations of from 2%, 3%, 4%, 5%, and 6%.

Figure 4:
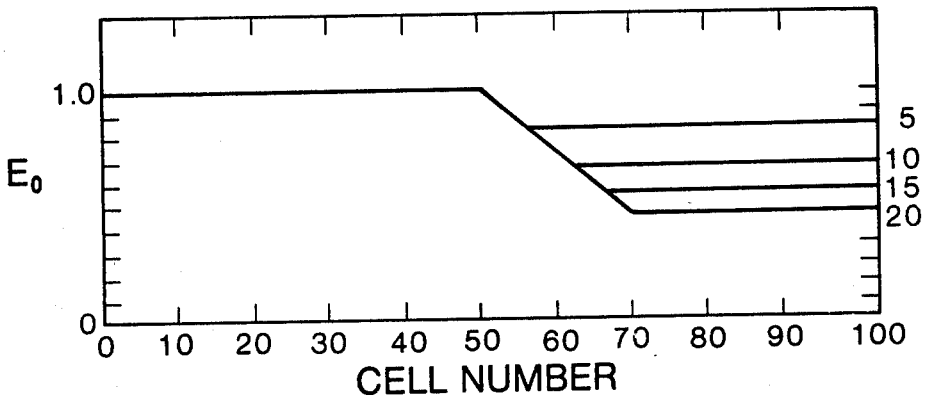
FIG. 4 is a diagram of energy distribution in a linear accelerator having five, ten, fifteen, and twenty 4% post-coupler perturbations.

FIG. 4 shows the field distributions that result when 5, 10, 15, and 20 post couplers are set for 4% perturbations, beginning at cell 50.

Figure 5:
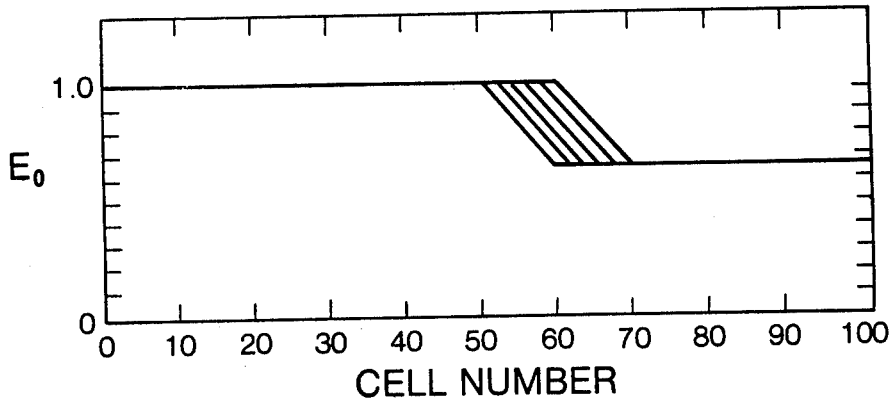
FIG. 5 is a diagram of energy distribution in a linear accelerator having ten 4% perturbations beginning at every other post coupler from number 50 through number 60.

FIG. 5 shows the result in field distributions when 10 post couplers are set for 4% perturbations beginning at cells 50, 52, 56, 58, and 60.

Table I gives the field reduction factors for all combinations of 5, 10, 15, and 20 post couplers 15 set for perturbations from 2% to 10%. In all cases where the total perturbation is large enough to drop the fields in the high-energy end of the drift-tube linear accelerator 11 below the level required for synchronous acceleration, the accelerated particle beam 27 will exit the drift-tube linear accelerator at a reduced energy with some energy spread. The resulting energies and energy spreads for a range of perturbations near the center of a typical 100 cell 70 MeV drift-tube accelerator 11 are given in Tables II–VI.

TABLE I

FIELD-REDUCTION FACTORS FOR SOME COMBINATIONS OF THE NUMBER AND SIZE OF THE INDIVIDUAL POST-COUPLER PERTURBATIONS

| Step Size | | Number of Steps | | | |
|---|---|---|---|---|---|
| | | 5 | 10 | 15 | 20 |
| 2% | 0.98 | 0.9039 | 0.8171 | 0.7386 | 0.6676 |
| 3% | 0.97 | 0.8587 | 0.7374 | 0.6333 | 0.5438 |
| 4% | 0.96 | 0.8154 | 0.6648 | 0.5421 | 0.4420 |
| 5% | 0.95 | 0.7738 | 0.5987 | 0.4663 | 0.3585 |
| 6% | 0.94 | 0.7339 | 0.5386 | 0.3953 | 0.2901 |
| 7% | 0.93 | 0.6957 | 0.4840 | 0.3367 | 0.2342 |
| 8% | 0.92 | 0.6591 | 0.4344 | 0.2863 | 0.1887 |
| 9% | 0.91 | 0.6240 | 0.3894 | 0.2430 | 0.1516 |
| 10% | 0.90 | 0.5905 | 0.3487 | 0.2059 | 0.1216 |

TABLE II

AVERAGE ENERGY AND ENERGY SPREAD IN MeV AS A FUNCTION OF THE NUMBER AND ORIGIN OF 2% FIELD STEPS

| Origin of Perturbations | Number of 2% Steps | | | |
|---|---|---|---|---|
| | 5 | 10 | 15 | 20 |
| 50 | 39.1± 3.1 | 69.7± 2.3 | 42.6± 1.3 | 39.8± 1.1 |
| 51 | 69.0± 4.4 | 43.5± 2.2 | 40.8± 1.3 | 40.4± 1.1 |
| 52 | 70.3± 2.4 | 44.3± 2.4 | 41.4± 1.3 | 41.1± 1.1 |
| 53 | 70.3± 1.4 | 45.5± 2.4 | 42.7± 1.3 | 41.9± 0.9 |
| 54 | 70.6± 0.4 | 46.6± 2.1 | 43.6± 1.4 | 43.2± 1.1 |
| 55 | 70.5± 0.7 | 47.2± 2.0 | 44.2± 1.2 | 43.9± 1.3 |
| 56 | 70.3± 0.9 | 48.3± 2.5 | 45.4± 1.3 | 44.6± 0.9 |
| 57 | 70.1± 3.0 | 50.0± 2.5 | 46.7± 1.6 | 46.1± 1.1 |
| 58 | 70.7± 0.2 | 51.1± 2.6 | 47.4± 1.6 | 46.9± 1.6 |
| 59 | 70.7± 0.3 | 52.0± 2.7 | 48.6± 1.0 | 48.1± 1.1 |

TABLE III

AVERAGE ENERGY AND ENERGY SPREAD IN MeV AS A FUNCTION OF THE NUMBER AND ORIGIN OF THE 3% FIELD STEPS

| Origin of Perturbations | Number of 3% Steps 5 | 10 | 15 | 20 |
|---|---|---|---|---|
| 50 | 46.7± 4.7 | 36.9± 1.0 | 36.2± 0.6 | 36.2± 0.6 |
| 51 | 47.8± 4.9 | 38.1± 1.2 | 36.9± 0.9 | 36.9± 0.8 |
| 52 | 48.4± 4.6 | 38.8± 1.1 | 37.9± 0.8 | 37.9± 0.6 |
| 53 | 50.1± 5.8 | 40.0± 1.2 | 38.7± 1.0 | 38.8± 0.9 |
| 54 | 50.8± 5.0 | 40.8± 1.2 | 39.7± 0.6 | 39.7± 0.6 |
| 55 | 52.1± 4.9 | 41.5± 1.1 | 40.5± 1.0 | 40.6± 0.9 |
| 56 | 53.0± 5.6 | 42.9± 1.2 | 41.4± 0.9 | 41.4± 0.8 |
| 57 | 54.1± 5.8 | 43.7± 1.4 | 42.4± 0.6 | 42.3± 0.5 |
| 58 | 56.6± 6.4 | 44.6± 1.1 | 43.5± 1.2 | 43.4± 1.0 |
| 59 | 57.8± 6.3 | 45.9± 1.3 | 44.4± 1.0 | 44.3± 0.9 |

TABLE IV

AVERAGE ENERGY AND ENERGY SPREAD IN MeV AS A FUNCTION OF THE NUMBER AND ORIGIN OF 4% FIELD STEPS

| Origin of Perturbations | Number of 4% Steps 5 | 10 | 15 | 20 |
|---|---|---|---|---|
| 50 | 39.1± 1.9 | 34.8± 0.8 | 34.2± 0.5 | 34.4± 0.4 |
| 51 | 40.3± 2.1 | 35.4± 0.7 | 35.1± 0.7 | 35.2± 0.7 |
| 52 | 41.2± 2.1 | 36.4± 0.9 | 35.9± 0.6 | 36.1± 0.6 |
| 53 | 42.2± 2.1 | 37.2± 0.9 | 36.8± 0.8 | 36.8± 0.8 |
| 54 | 43.7± 2.0 | 38.4± 0.8 | 37.8± 0.5 | 38.0± 0.5 |
| 55 | 44.2± 2.1 | 39.1± 0.8 | 38.6± 0.8 | 38.7± 0.8 |
| 56 | 45.1± 2.2 | 40.1± 0.8 | 39.4± 0.5 | 39.6± 0.5 |
| 57 | 46.6± 2.2 | 40.9± 1.1 | 40.4± 0.8 | 40.4± 0.7 |
| 58 | 47.2± 2.0 | 41.9± 0.7 | 41.3± 0.9 | 41.5± 0.8 |
| 59 | 48.5± 2.9 | 43.0± 1.0 | 42.3± 0.5 | 42.3± 0.5 |

TABLE V

AVERAGE ENERGY AND ENERGY SPREAD IN MeV AS A FUNCTION OF THE NUMBER AND ORIGIN OF 5% FIELD STEPS

| Origin of Perturbations | Number of 5% Steps 5 | 10 | 15 | 20 |
|---|---|---|---|---|
| 50 | 36.5± 1.2 | 33.3± 0.7 | 33.0± 0.5 | 33.2± 0.6 |
| 51 | 37.1± 1.1 | 34.0± 0.5 | 33.8± 0.5 | 33.9± 0.5 |
| 52 | 38.4± 1.4 | 34.9± 0.7 | 34.8± 0.8 | 34.9± 0.7 |
| 53 | 39.0± 1.4 | 35.7± 1.2 | 35.6± 0.5 | 35.7± 0.4 |
| 54 | 40.0± 1.4 | 36.8± 0.8 | 36.5± 0.7 | 36.7± 0.7 |
| 55 | 41.0± 1.4 | 37.7± 0.6 | 37.4± 0.4 | 37.5± 0.5 |
| 56 | 42.1± 1.5 | 38.5± 0.9 | 38.1± 0.6 | 38.4± 0.6 |
| 57 | 43.3± 1.6 | 39.4± 0.6 | 39.1± 0.5 | 39.3± 0.5 |

TABLE V-continued

AVERAGE ENERGY AND ENERGY SPREAD IN MeV AS A FUNCTION OF THE NUMBER AND ORIGIN OF 5% FIELD STEPS

| Origin of Perturbations | Number of 5% Steps 5 | 10 | 15 | 20 |
|---|---|---|---|---|
| 58 | 43.8± 1.5 | 40.3± 0.7 | 39.9± 0.4 | 40.1± 0.5 |
| 59 | 44.9± 1.4 | 41.3± 0.9 | 40.9± 0.7 | 41.1± 0.8 |

Higher energies result when the perturbations are moved toward the high-energy end of the drift-tube linear accelerator 11 and lower energies result when the perturbations are moved toward the low-energy end of the drift-tube linear accelerator 11.

In a permanent-magnet focused type of drift-tube linear accelerator 11, a lower limit to the energies exists for which the present invention is suitable and below which the particle beam becomes unstable. In a 70-MeV drift-tube linear accelerator, for example, this limit is about 20 MeV.

Table I shows that five 2% perturbations give a field reduction factor of only 0.939, which is not low enough to drop the particle beam out of synchronization. The left-hand column of Table II confirms that situation, showing the average energy in each case to be close to unperturbed value of 70 MeV. All other combinations in Table I show an energy reduction capability. However, those combinations with field reduction factors exceeding 0.8 yield the largest energy spreads in Tables II–VI. Ten 4% perturbations give a field reduction factor of 0.6648 which will yield a relatively well-defined energy-reduction capability with root-mean-square energy spreads of 1 MeV or less.

In order to achieve all of the field distributions illustrated in FIG. 3, a proportional control of the magnitude of the perturbations on the individual post couplers 15 would be required. However, in accord with the present invention, field distribution can be controlled with simple binary control of the number and location of the post couplers 15 producing perturbations of fixed magnitude, see FIGS. 4 and 5. As shown, the present invention can yield any desired energy, within the limits of the drift-tube linear accelerator 11, to a resolution of 1 MeV or less and an energy spread of ±1 MeV or less.

With reference again to FIG. 1, it can be appreciated that each post coupler 15 can be set to one of two positions via a binary control signal from post-coupler controller 25. Thus by programming of the post coupler controller 25 a great selection of energy levels can be easily achieved and readily modified. Depending upon particular application requirements the post-coupler controller can be physically realized by virtually anything from a set of manually operated switches to a digital decoder responsive to programmed control information.

The foregoing description of a preferred embodiment of the invention has been presented for purposes of illustration and description. It is not intended to be exhaustive or to limit the invention to the precise form disclosed, and obviously many modifications and variations are possible in light of the above teaching. The embodiment was chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A variable-energy linear accelerator system comprising;

a linear accelerator having an input for receiving a particle beam at a particular energy level and an output for emitting said particle beam at a higher energy level;

a plurality of drift-tubes forming a chain thereof between said input and said output of said linear accelerator;

rf source means coupled to said linear accelerator for providing an rf field therein for accelerating said particle beam through said plurality of drift-tubes;

a plurality of post couplers within said linear accelerator, each post coupler thereof individually associated with an individual drift-tube in said plurality thereof, each post coupler thereof being positionable to a first and second position, said first position being an rf field unperturbing position and said second position being an rf field perturbing position;

controllable positioning means coupled to each post coupler in said plurality thereof for positioning each post coupler selectively to said first and said second positions; and control means coupled to said positioning means for controlling the position of each post coupler in said plurality thereof.

2. The invention according to claim 1 wherein said second position of each post coupler is a slight rf field perturbing position.

3. The invention according to claim 2 wherein each said slight rf field perturbing position produces an rf field perturbation between 2% and 6%.

4. The invention according to claim 1 wherein said controllable position means includes a plurality of binary positioning devices, each binary positioning device therein individually associated with an individual post coupler in said plurality thereof.

5. The invention according to claim 3 wherein each binary position device in said plurality thereof includes an electrical solenoid actuating unit.

6. The invention according to claim 3 wherein each binary position device in said plurality thereof includes an air cylinder actuating unit.

7. The invention according to claim 3 wherein said controls means provides a separate binary control signal to each binary position device in said plurality thereof.

* * * * *